United States Patent [19]

Garcea

[11] 4,231,330

[45] Nov. 4, 1980

[54] TIMING VARIATOR FOR THE TIMING SYSTEM OF A RECIPROCATING INTERNAL COMBUSTION ENGINE

[75] Inventor: Giampaolo Garcea, Milan, Italy

[73] Assignee: Alfa Romeo S.p.A., Milan, Italy

[21] Appl. No.: 20,193

[22] Filed: Mar. 13, 1979

[30] Foreign Application Priority Data

Mar. 24, 1978 [IT] Italy ..... 21650 A/78

[51] Int. Cl.[3] ..... F01L 1/34

[52] U.S. Cl. ..... 123/90.15; 64/25

[58] Field of Search ..... 123/90.15, 90.17, 90.31, 123/97; 64/24, 25; 74/568, 395

[56] References Cited

U.S. PATENT DOCUMENTS

| | | | |
|---|---|---|---|
| 2,107,070 | 2/1938 | Fleury | 64/25 |
| 2,162,243 | 6/1939 | Browne | 123/90.15 X |
| 3,258,937 | 7/1966 | Kranc et al. | 123/90.15 |
| 3,401,572 | 9/1968 | Bailey | 123/90.15 X |

*Primary Examiner*—Harry N. Haroian

*Attorney, Agent, or Firm*—Charles E. Brown

[57] ABSTRACT

This invention relates to a timing variator for the timing system of a reciprocating internal combustion engine of the type having a camshaft for the intake valves and another camshaft for the exhaust valves. At least one of said camshafts is coupled to a driving gear through an annular piston housed in a cavity connected to the outside through a slide valve. The latter includes a valve element provided with an eccentric mass, which is able to overcome the force of a preloaded spring and to move the valve element from open to closed position when the rotational speed of the engine is higher than a predetermined value.

2 Claims, 4 Drawing Figures

TIMING VARIATOR FOR THE TIMING SYSTEM OF A RECIPROCATING INTERNAL COMBUSTION ENGINE

The mixture intake into the cylinder of a reciprocating internal combustion engine and the discharge of the exhaust gas from the cylinder are notably optimised by suitably timing the opening and closing of the intake and exhaust valves relative to the piston movements and consequently relative to the crankshaft.

This optimisation must take account firstly of the time available for the passage of the air and gas, and which becomes increasingly shorter as the engine rotational speed increases, but also has to take account of the kinetic energy of the air and gas in their respective conduits, and of the inertia phenomena connected with said kinetic energy which obviously increases with the square of the increase in rotational speed. Consequently if timing is optimised for a certain rotational speed, it is generally no longer optimised for a different rotational speed, and in particular for a much different rotational speed.

The ideal solution would be to continuously vary the timing automatically as a function of the rotational speed. However, automatic control of this type would have to be very complicated to ensure that the timing corresponded to the rotational speed with sufficient accuracy. For this reason, it is preferred in the device according to the present invention to provide only two different timings, one being averagely optimised for rotational speeds lower than a set value, and the other being averagely optimised for rotational speeds exceeding this value. As the two timings correspond to the two limiting positions of a mobile element inside the automatic device, the timings are completely accurate. Thus in each of the two ranges over which the engine is used, i.e. below and above the said rotational speed, the other parameters (for example mixture ratio, ignition advance etc.) which control not only the regular operation of the engine but also the minimising of the unburnt components in the exhaust and the fuel consumption, can be optimised while keeping the timing fixed.

The two said limiting positions inside the device are those relative to the sliding of an intermediate mobile member in the coupling between the camshaft and driveshaft.

This intermediate member moves as soon as one of the two opposing forces acting on it, namely the preloading of a spring and the engine lubricating oil pressure, exceeds the other. This latter either acts on the intermediate member or not, depending upon whether an oil vent port is closed or open. This port is controlled by a valve provided with a valve element on which two opposing forces act, namely the preloading of a second small spring and the centrifugal force due to a mass rigid with the valve element, which rotates together with the camshaft, with its centre of gravity displaced from the camshaft rotational axis.

For the engine to operate properly and for minimising harmful emissions and fuel consumption (as heretofore stated), the precision requirements extend not only to the value to the two timings, but also to the value of the transition speed from one timing to the other. To satisfy this second precision requirement in the device according to the present invention, the valve element is characterised in that the loads acting on it in the direction of its displacement are represented only by the two opposing forces. The resultant of the oil pressures is zero as a valve element has been chosen which is of the balanced slide valve type in which the resultant of the oil pressures along the normal to the displacement is zero. Friction loads are also practically zero, as the centrifugal forces have no component normal to the displacement direction.

Figure 1:
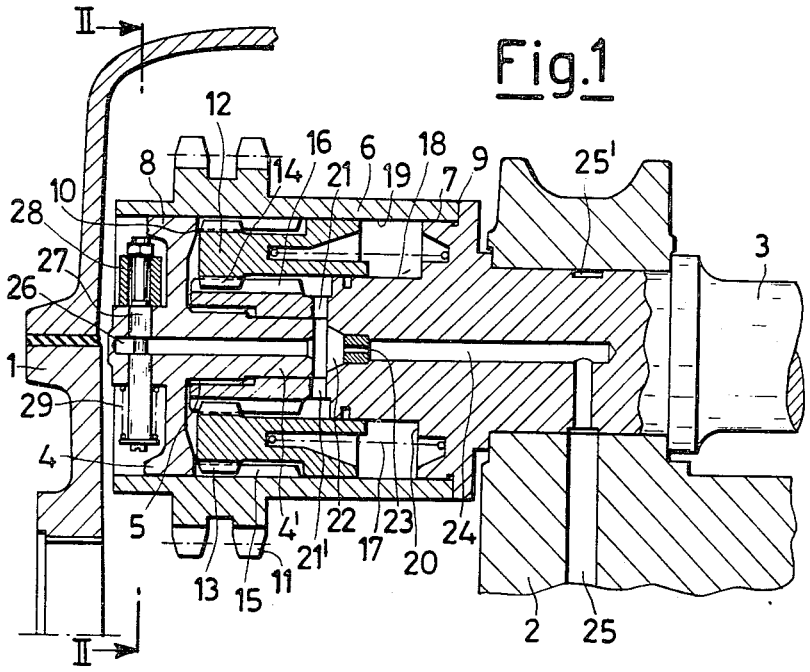
FIG. 1 shows a section through a camshaft of an engine showing the timing variator

The above can be seen with greater clarity with reference to the accompanying FIG. 1, which shows a section through a camshaft disposed in the engine head, on a plane passing through the camshaft axis. This sectional figure shows only the part of interest, i.e. the part relative to the end of the camshaft, which is controlled for example by a chain from the driveshaft. In this section, the refernece numeral 1 indicates a wall of the engine head, and 2 that part of the head which comprises the end support for the corresponding pivot of the camshaft 3. The end disc 4 is rigid with the camshaft 3, it being locked by the thread 5 provided on the cylindrical extension 4' of the disc itself. The cylindrical sleeve 6 coaxial with the camshaft is rotatably supported at its ends on the cylindrical surface 7 of the camshaft and on the cylindrical surface 8 of the disc 4.

The ledge 9 on the camshaft 3 and the ledge 10 on the disc 4 prevent any axial sliding of the sleeve 6 relative to the shaft 3 and member 4. The reference numeral 11 indicates the external toothing rigid with the sleeve 6, in which the chain, not shown in the figure, engages to connect the sleeve to the engine crankshaft (not shown in the figure). The sleeve 6 also comprises internal toothing 15, which engages with the external toothing 13 on the annular piston 12, which is also provided with internal toothing 14. This latter toothing 14 engages with external toothing 16 on the camshaft 3. At least one of the two meshing pairs of toothing (14, 16; 13, 15) is helical. Moveover, one of the toothing of the two pairs extends axially much further than the other. The result is that with the two pairs of toothing remaining continuously engaged, an axial sliding movement of the annualr piston 12 relative to the camshaft 3, disc and sleeve 6 causes the camshaft to rotate about the sleeve 6, and consequently about the crankshaft which is connected to the sleeve 6 by the chain. The extent of this rotation, i.e. of this variation in the timing of the crankshaft relative to the driveshaft, depends on the extent of the axial movement of the annular piston 12 relative to the camshaft, and on the slope of the helical toothing (or toothings). The two pairs of toothings are constructed in such a manner as not to obstruct the oil flow, either by means of a suitable gap between the teeth or by eliminating one or more teeth. In FIG. 1, the annular piston 12 is shown in one of its two limiting positions, it being kept in contact with the said ledge 10 of the end disc 4 by the preloading of the spring 17. The annular piston 12 is characterised in that at the end opposite the internally and externally toothed end, two gauged cylindrical surfaces, one internal and one external, adhere to corresponding gauged cylindrical surfaces, one external on the shaft 3 and indicated by 18, and the other internal in the sleeve 6 and indicated by 19.

The radial gap between the cylindrical surfaces which adhere together is very small, so that any possibility of oil seepage between the cylindrical surfaces is very low, even when under pressure. On that annular surface of the even when under pressure. On that annular surface of the piston 12 normal to the axis and opposite that on which the spring 17 acts, there can act a hydraulic pressure having such a value as to overcome the preloading of the spring 17, so that the piston is thrust in the direction contrary to the action of the spring until it adheres to the ledge 20 on the shaft 3, which defines the second limiting position of the piston 12. The oil under pressure can reach the pistion through the bores 21 and 21', from the cavity 22 which is fed with oil through the small port 23 in the duct 24 which is provided in the shaft 3. The oil reaches the duct 24 from the annular cavity 25' and the duct 25 provided in the head 2. The duct 25 also feeds lubricating oil to the coupling between the pivot of the shaft 3 and the corresponding bore provided in the head 2. The cavity 22 can be put into communication with the outside of the device, but within the engine head, through the duct 26 provided in the cylindrical extension 4' and the two ducts 30 and 31 (visible in FIG. 2) when these are not blocked by the valve element 27 of the slide valve provided in the end disc 4.

Figure 3:
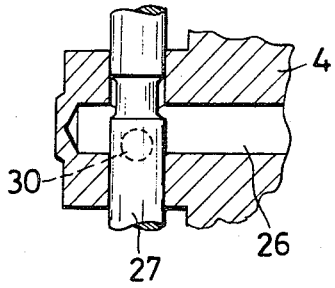
FIG. 3 shows an enlarged view of the valve element 27.
Figure 4:
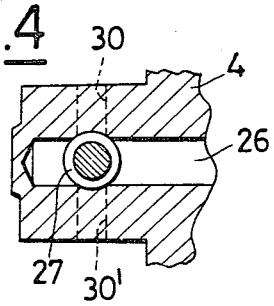
FIG. 4 is a section along section IV—IV of FIG. 2.

The two ducts 30 and 30' are normal to the duct 26, but are slightly off-centred and therefore skew thereto, so that even when they are intercepted by the valve element 27, the oil under pressure still reaches the end of the duct 26, and exerts on the contour of the valve element 27 a uniform pressure which completely balances it. The constructional details of this method are clearly visible in FIGS. 3 and 4, the first of which shows the enlarged valve element 27 in the position in which it intercepts the ducts 30 and 30', and the second of which is a section through the valve element on the line IV—IV of FIG. 2.

The axis of the valve element 27 and consequently its opening-closing stroke are in a direction normal to the axis of the element 4, and therefore of the camshaft 3. The result is that as the eccentric mass 28 is rigid with the valve element 27, the centrifugal force relative to this mass can, as the rotational speed increases, overcome the preloading of a small spring 29 which tends to keep the valve element in its limiting position corresponding to the opening of the ducts 30 and 30', so as to move the valve element into the limiting position corresponding to closure of the ducts 30 and 30'. Thus below a certain speed, the ducts 30 and 30' are open and the pressure of the oil reaching the cavity 22 through the small port 23 is constantly practically zero, with the result that the resultant of said pressure on the annular piston 12 is zero. This latter is kept by the action of the spring 17 in its first limiting position, corresponding to a first timing of the camshaft. Above said speed, the ducts 30 and 30' are closed. The oil pressure in the cavity 22 and consequently on the surface of the annular piston 12 is the same as in the engine lubrication circuit. The resultant of the oil pressure overcomes the preloading of the spring 17, and the annular piston 12 is moved into and kept in its second limiting position corresponding to the second timing of the camshaft.

Figure 2:
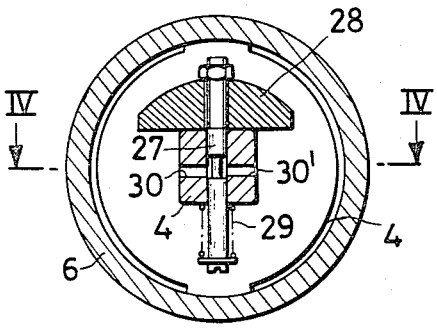
FIG. 2 is a section along II—II of FIG. 1 showing the mass 28 and valve element 27

FIG. 2 shows a section through the device on the line II—II of FIG. 1, normal to the rotational axis of the camshaft and passing through the axis of the valve element 27. This section shows the valve element 27 in its seat provided in the end disc 4. It also shows the mass 28 rigid with the valve element 27, and the spring 29 which keeps the valve element in its open position when the rotational speed is less than the said set value.

What I claim is:

1. An internal combustion engine especially for motor vehicles in which the intake valves are controlled by one camshaft and the exhaust valves by a different camshaft, both of said camshafts being provided at one end with a gear for their drive by means of the engine crankshaft and for their appropriate timing relative to said crakshaft, the coupling of at least one of said camshafts with its gear being made by way of an intermediate member constituted by an annular piston provided with a first groove in the gear, and with a second groove which engages in a groove in the shaft, at least one of said grooves in the annular piston and the groove with which it engages being helical so that the other groove of the annular piston and the groove with which it engages can be longitudinal, said annular piston being able to make an axial sliding movement along the axis of the camshaft and of the gear, said sliding movement being limited by two limiting contact surfaces which are fixed relative to the shaft, the loading of a spring in the direction of the camshaft axis tending to keep the annular piston in a first of the two limiting positions, whereas the pressure of the engine lubricating oil can exert on one surface of the annular piston a force capable of overcoming the loading of said spring so as to move it axially and to keep it in the second of the two limiting positions, the lubricating oil flowing through a small port to the cavity in which the annular piston is located, wherein said cavity can be connected to the outside through a slide valve, the valve element of which moves in a direction normal to the camshaft axis in being displaced from the opening to the closure position, said valve element being provided with a single mass eccentric to the camshaft axis, the force of a preloaded spring acting on said valve element in its sliding direction to maintain it in its open position when the rotational speed of the engine and thus of the camshaft is less than the value for which the centrifugal force applied to the eccentric mass is equal to the preloading of the spring, whereas at higher rotational speeds the centrifugal force overcomes the preloading of the spring to move the valve element into the closure position, so that, at speeds less than said value, as the valve element is in the open position the oil pressure falls considerably because of the existence of said small port, and thus the annular piston is kept by the axial spring in its first limiting position, whereas, at speeds higher than said value, as the valve element is in the closure position, the annular piston is moved to, and kept, in its second limiting position by the oil pressure such that, because of the path of one of the grooves in said annular piston, at speeds lower than said value a first determined timing of the camshaft is obtained relative to the driveshaft, whereas at higher speeds a second determined timing is obtained.

2. An engine as claimed in claim 1, wherein the oil reaches said slide valve through a first duct, whereas it is discharged through at least one second duct the axis of which is skew and is directed substantially orthogonally to, but spaced apart from, the axis of said first duct.

* * * * *

UNITED STATES PATENT AND TRADEMARK OFFICE

CERTIFICATE OF CORRECTION

PATENT NO. : 4,231,330

DATED : November 4, 1980

INVENTOR(S) : Giampaolo Garcea

It is certified that error appears in the above-identified patent and that said Letters Patent is hereby corrected as shown below:

Column 4, line 16, after "groove", first occurence, insert -- which engages in a groove --.

Signed and Sealed this

Twenty-eighth Day of March, 1989

*Attest:*

DONALD J. QUIGG

*Attesting Officer*

*Commissioner of Patents and Trademarks*